US005529543A

United States Patent [19]

Beaumont, Sr.

[11] Patent Number: 5,529,543

[45] Date of Patent: Jun. 25, 1996

[54] GOLF IRONS WITH INCREASED CONSISTENCY

[76] Inventor: Gregory J. Beaumont, Sr., 1238 S. Douglas, Arlington Hts., Ill. 60005

[21] Appl. No.: 349,799

[22] Filed: Dec. 6, 1994

[51] Int. Cl.[6] ..... A63B 53/04

[52] U.S. Cl. ..... 473/290; 473/329; 473/332

[58] Field of Search ..... 273/78, 77 R, 273/167 R, 167 J, 167 F, 167 H, 169, 171, 172, 173, 77 A

[56] References Cited

U.S. PATENT DOCUMENTS

| | | | |
|---|---|---|---|
| 819,900 | 5/1906 | Martin | 273/78 |
| 925,389 | 6/1909 | Royce | 273/78 |
| 2,429,351 | 10/1947 | Fetterolf | 273/78 |
| 4,027,885 | 6/1977 | Rogers | 273/169 |
| 4,398,965 | 8/1983 | Campau | 273/78 |
| 4,523,759 | 6/1985 | Igarashi | 273/169 |
| 4,854,581 | 8/1989 | Long | 273/77 A |
| 5,176,384 | 1/1993 | Sata | 273/78 |

FOREIGN PATENT DOCUMENTS

| | | | |
|---|---|---|---|
| 3822 | 12/1893 | United Kingdom | 273/78 |
| 4631 | 4/1900 | United Kingdom | 273/78 |
| 2259863 | 3/1993 | United Kingdom | 273/78 |

*Primary Examiner*—Sebastiano Passaniti

[57] ABSTRACT

Each iron in a golf club set is made to have a more consistant distance spectrum across its club face. This is done by deadening its sweet spot area so that the distance achieved with an on center hit is less, thereby making a center hit and an off center hit more nearly the same. The consistency of the average golfer is thereby improved, leading to lower scores and more enjoyable sport. The "dead center" irons may have their face angles, or loft, reduced to increase overall distance in order to compensate for the reduced distance reaction of the center hit, in order that the irons of a specific type or number will retain their traditional distance reaction.

22 Claims, 9 Drawing Sheets

GOLF IRONS WITH INCREASED CONSISTENCY

BACKGROUND OF THE INVENTION

1. Field of the Invention

The present invention relates to golf clubs of the iron type. The present invention relates specifically to golf club irons having a ball impact distance reaction spectrum of greater consistency across the striking face of the club.

2. Discussion of the Related Art

In the game of golf there are basically two kinds of clubs when excluding the putter. The first kind is drivers which are used to hit the ball as far as possible. These clubs are also refered to as "woods". The second kind of club is the controlled distance club which is used to hit the ball a given, or specific amount of distance dictated by the position of the ball on the course. These kind of clubs, including the wedges and the five wood, are referred to herein as "irons".

As anyone with a passing experience in golf will know, it is the consistency of the golfer's "short game" and his use of the controlled distance clubs, that is the key to better play, low scores, and more enjoyable sport.

In the art of golf club construction much attention has been paid to increasing the distance of the ball flight when it is struck, referred to herein as "distance reaction", squarely. This might be colloquially refered to as "hot rodding the sweet spot". This is not the subject of the present invention.

As seen in FIG. 1, the striking face 21 of a known golf club 23 has a useful area defined by a center area 25, a high area 27, a low area 29, a toe area 31 and a heel area 33. These are general designations, the general areas do not have specific boundaries. Within the center area lies the sweet spot 35 which is the center of gravity of the head. A ball hit from this spot will travel farther than an off center hit, all other things being equal. The reader wishing to know more about the physics of golf will find voluminous literature available. As the point of contact with the ball moves away from the sweet spot 35 the distance reaction will decrease.

FIG. 2 illustrates this phenomenon by illustrating the distance reaction "face map" for typical numbers five and six golf irons. The distance reaction for each area of the club face is marked along the Y-axis with C being center, L low, Hg high, Hl heel, and T toe. Ball flight path variation is show as deviation on the X-axis. The typical iron has a substantially uniform stiffness over the striking face. It will be appreciated that, depending on where the striking face 21 contacts the ball, a distance reaction variation, or spectrum, of over fifteen yards may result. A ball may land over the green, on the green, or in a sand trap within this distance reaction spectrum.

Psychologically, a golfer will select his specific distance club assuming he will hit the ball on center and get maximum distance from his shot. Realistically, the average golfer would probably be better off assuming an off center hit and going down a club number, or "over clubbing", to get the same desired distance as from an on center hit with his higher numbered club. This is because the average nonprofessional golfer lacks the skill necessary to contact the sweet spot consistently. That is, he is more likely to hit off center than on center. However, his score still suffers when he hits the lower numbered club on center and the ball goes too far. This is why golf is always a challenge.

What is needed in the art is a golf club construction which has a more uniform, or predictable, distance reaction spectrum over the striking face of the specific distance clubs to enable the average amateur golfer to better improve his game. This is the object of the present invention.

SUMMARY OF THE INVENTION

The present invention improves the consistency of the distance reaction, or narrows its spectrum, for a specific distance golf club by removing stiffness from the high reaction center area of the club head striking face until it substantially matches the lower distance reactions of the other, off center, areas of the striking face.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DETAILED DESCRIPTION OF THE PREFERRED EMBODIMENT

Figure 1:
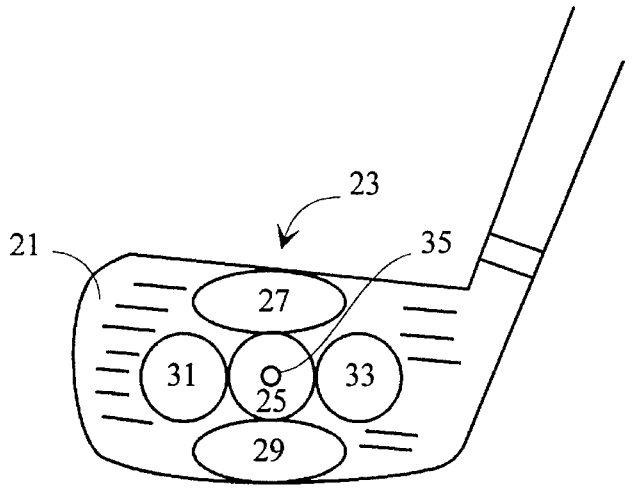
Fig. 1 (PRIOR ART)
FIG. 1 is an elevation view of a known golf club iron head striking face illustrating the different striking areas thereon.
Figure 2:
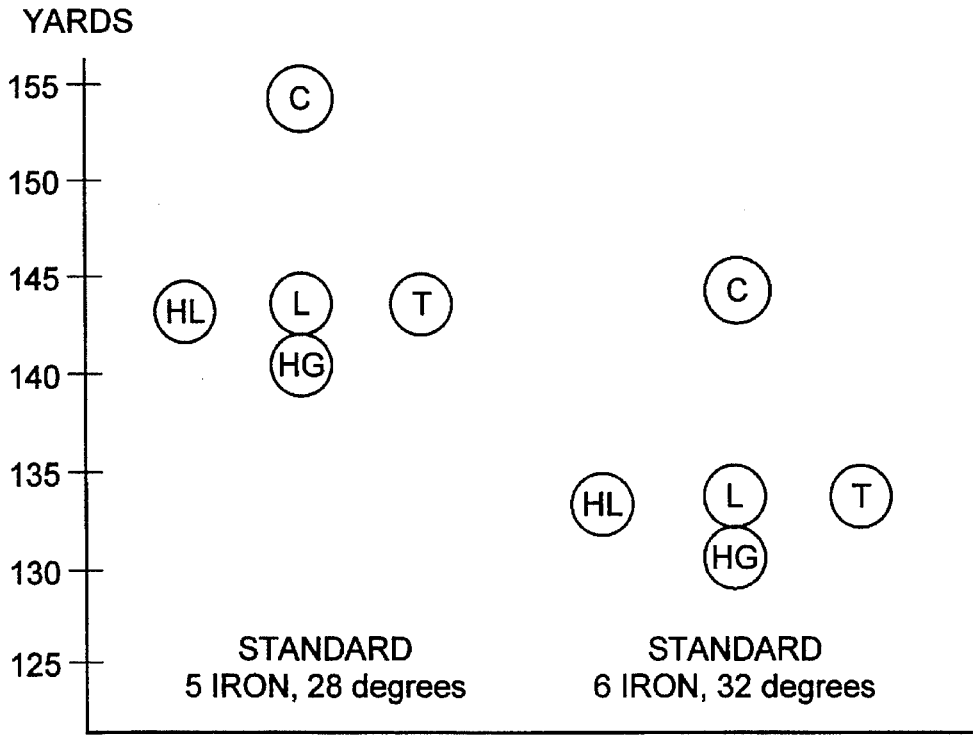
Fig. 2 (PRIOR ART)
FIG. 2 is a distance reaction face mapping chart for a known five and six iron showing the distance reaction of a ball struck by each area of the striking faces.
Figure 3:
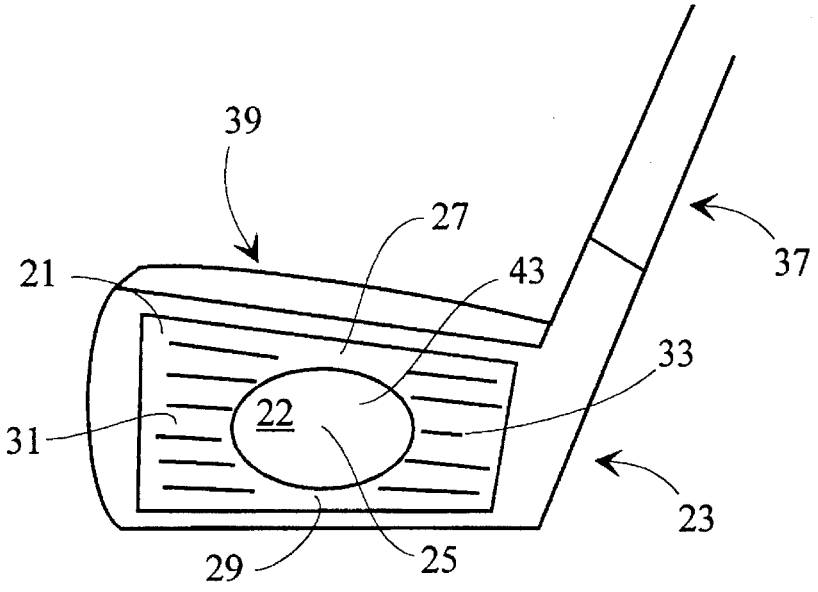
FIG. 3 is an elevation view of a golf club iron with a head according to a first generic embodiment of the present invention.

As seen in FIG. 3, a first generic embodiment of the present invention generally comprises a golf club 23 having a shaft 37 affixed to a club head 39 having a void (not shown) formed therein behind the center area 25. Affixed over, or into, the void, by epoxy (not shown) or the like, and having a surface 22 forming the center area of striking face 21, is a plate or plug, as further described below, composed of a material having a lesser stiffness, or hardness, or more energy absorbent than, the material of the club head surrounding the center area 25. Suitable materials may include fiberglass or spring steel for the plate and various rubber or polymer compositions for the plug.

Figure 4:
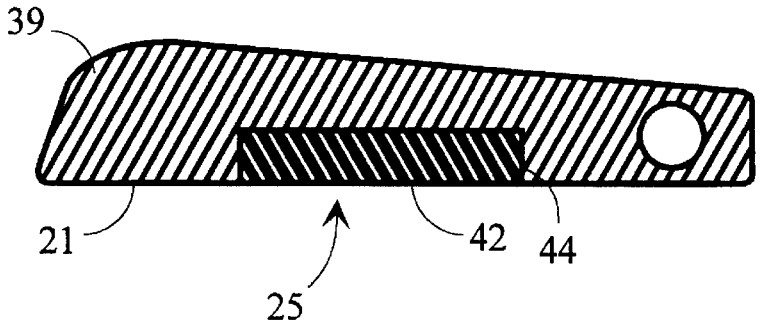
FIGS. 4–8 are cross sectional plan views of the invention detailing embodiments having a plug of lesser stiffness than the club head inserted therein.

As seen in FIG. 4, a plug 42 fills a relatively shallow depression 44 in the club head 39 which is coextensive with the center area 25 of the striking face 21. Because the plug 42 is softer, i.e., of lesser stiffness, or lower durometer, than the surrounding striking face material, the plug 42 inserted into the depression 44 will have a lower distance reaction than that part of the striking face backed by the club head material and therefore, inflexible. Thus, because of the location of the plug 42 in the center area 25 of the striking face 21, the distance reaction of the center area 25 is made more nearly like the distance reaction of the other striking face areas, ie., the high area 27, low area 29, toe area 31, and heel area 33. Thus whether the ball is struck on center or off center the ball will travel more nearly the same distance, ie., the distance reaction spectrum is narrowed for the club 23. It is considered within the skill of the ordinary golf club designer artisan to select the proper material or materials necessary for durability, weight matching, distance reaction reduction, etc. to achieve the desired distance reaction reduction in a balanced golf club.

Figure 5:
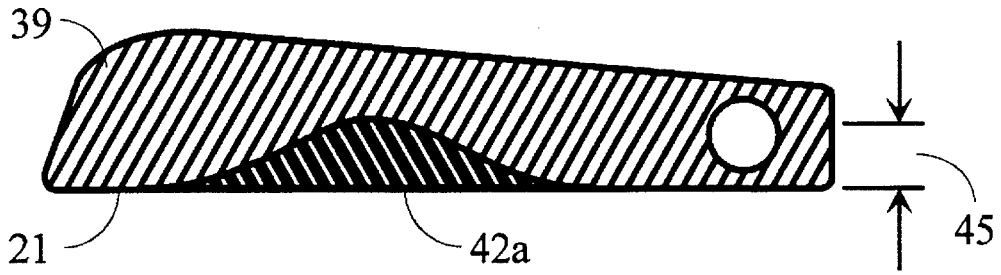

As seen in FIG. 5 the plug 42 of FIG. 4 may be replaced with a plug 42*a* that is tapered, or pyramidal shaped from a greater depth 45 over the center point of the club head to a meeting with the striking face 21 than is true for the other club face areas which have a softer material backing of lesser depth so as to provide more resilience in the center and less at the other areas to compensate for each specific area distance reaction, thereby more nearly equalizing the distance reaction over the striking face 21.

Figure 6:
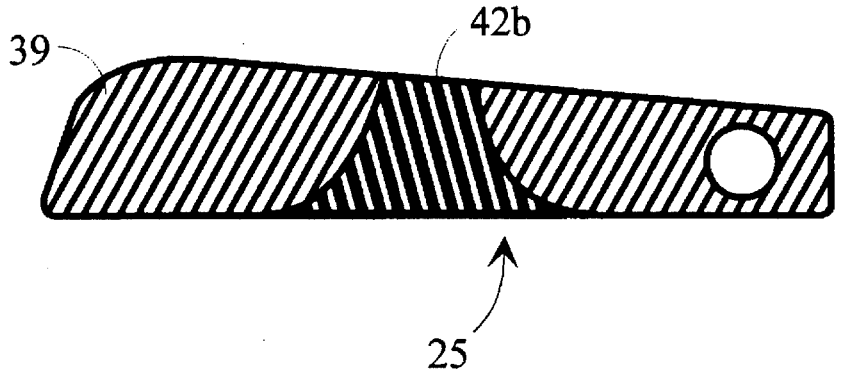

As seen in FIG. 6, an alternative embodiment of FIG. 5 shows the club head 39 with a plug 42*b* of less stiff or softer material which extends through the club head 39 and is deepest in the center area 25, and tapers to a shallow depth towards the low, toe, and heel areas 29, 31, 33 (FIG. 3).

Figure 7:
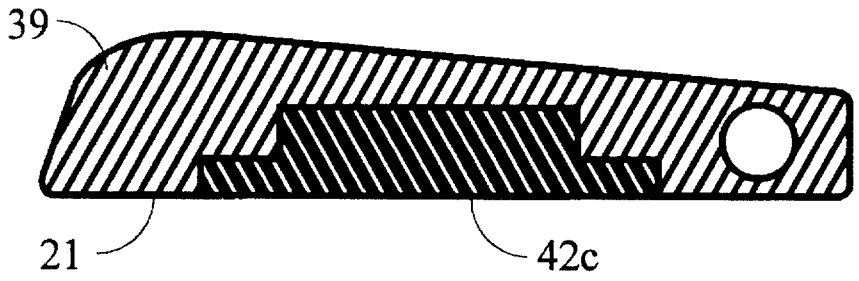
Figure 8:
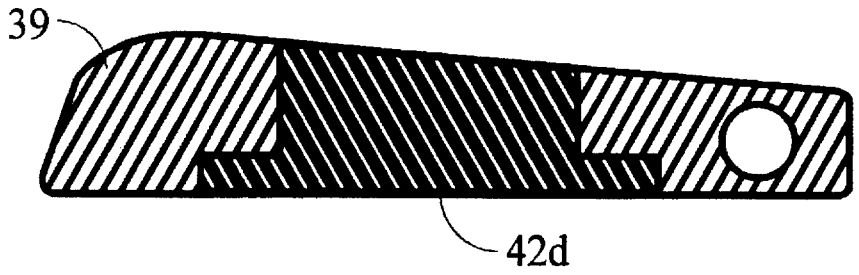

Referring to FIG. 7, the striking face 21 may be composed of a plug 42*c* of less stiff or softer material which extends in a series of rectangles of decreasing area into a void in the club head so as to extend more deeply behind the center area and less deeply behind the off center areas. In FIG. 8, an alternative embodiment to that of FIG. 7, the softer material of the plug 42*d* may be extended in depth throughout the club head 39. The plug behind the center area is of greater depth to lessen the distance reaction thereof according to the teachings of the present invention.

Figure 9:
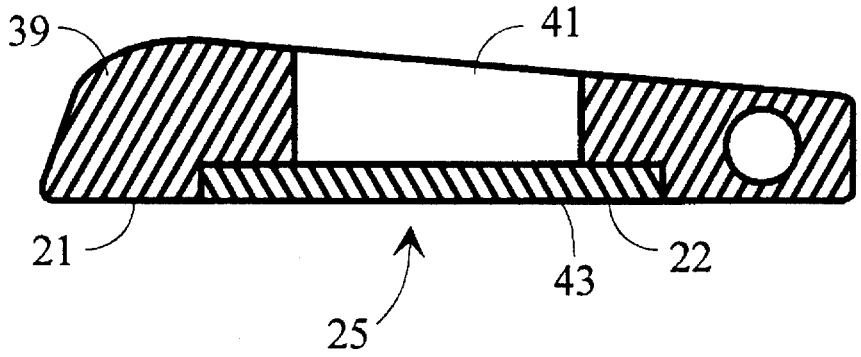
FIGS. 9–11 are cross sectional views of the invention detailing embodiments having a deformable plate forming a part of the striking face set over a void in the club head.
Figure 10:
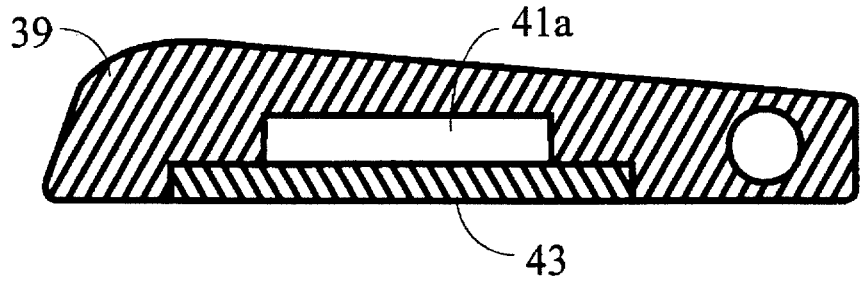

As seen in FIG. 9, the void 41 may extend as a through-hole in the club head 39. The void 41 may then extend through the entire club head 39, or as seen in FIG. 10, a void 41*a* may extend only partially into the club head 39. Affixed over the void 41, by epoxy (not shown), or the like, and having a surface 22 forming the striking face 21, is a thin plate 43 composed of a material which is stiff, or hard, but deformable upon impact with the ball. A suitable material for the plate is spring steel. While being a hard material, the thin plate will deform, upon striking the ball, into the void thereby absorbing some of the energy which would otherwise be imparted to the ball. Thus, the distance reaction of the striking face will be lessened in the center area of the club according to the teachings of the present invention.

Figure 11:
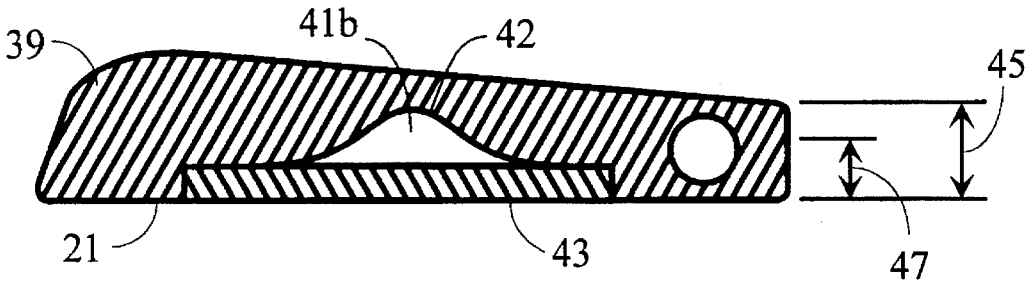

As seen in FIG. 11, the void 41*b* may be shaped to provide a greater depth 45 for deflection of the plate behind the center area 25. The void 41*b* then becomes more shallow 47 as it moves off the center area sweet spot and approaches the other striking face areas of the plate 43 to allow less deflection of the plate 43 behind the areas which do not need as much lessening of their distance reactions in order to more nearly equalize the distance reaction spectrum over the entire striking face.

Figure 12:
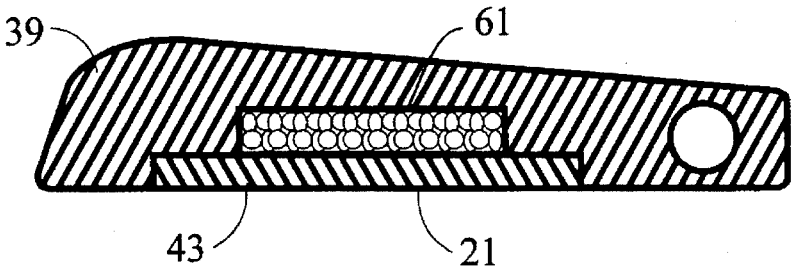
FIGS. 12–14 are cross sectional views of the invention detailing embodiments having a plate forming a part of the striking face set over a plug of lesser stiffness set into the club head.
Figure 13:
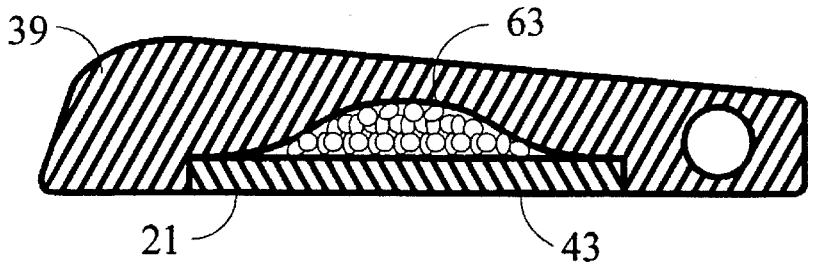

As seen in FIG. 12, the area behind the center of the striking face 21 and the plate 43 may be comprised of a plug or insert 61 of less stiff, or softer, material than the club head 39 extending midway through the thickness of the club head and with the plate 43 being affixed thereover. Alternatively, as seen in FIG. 13, an insert 63 of similar material may be utilized but which differs in the respect that the shape of the less stiff material graduates from a depth greatest behind the center area of the striking face to a lesser depth behind the off center areas while serving as a backing for substantilly the entire plate.

Figure 14:
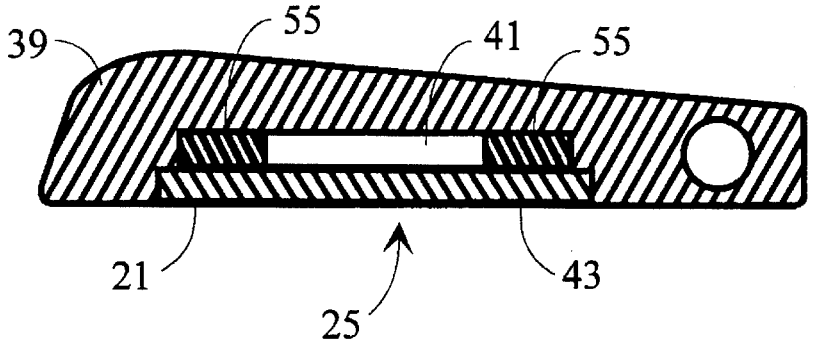

As seen in FIG. 14, the thin plate 43 of deformable but resilient metal forms at least a part of the striking face 21 for this embodiment. Behind the plate 43 is the void 41 extending into the club head 39 and covering substantially the entire area behind the striking face 21. The off-center areas behind the striking plate, i.e. the backing of the heel, toe, low and high areas are filled with a material 55 of lesser stiffness than that of the surrounding club head 39. The void 41 is left hollow behind the center area 25. The plate 43 will yield farthest before bottoming out upon contact with the ball in the center area 25 resulting in the greatest loss of distance reaction. The plate 43 will have less travel before bottoming out against the compressed lesser stiffness material 55 in the low, toe, high and heel areas resulting in less loss of distance reaction. Thus, upon proper construction, the distance reaction over the useful striking face area will be more nearly equalized. It will be appreciated that a variety of shapes for the void and plate may be utilized depending upon the effects desired and manufacturing expediencies. As seen in elevation at the club face, circular, ellipsoid, triangular, cruciform and quadrangular shapes, among others, are contemplated with the depth of the void or the more compressible material being varied accordingly behind the club face areas.

Figure 15:
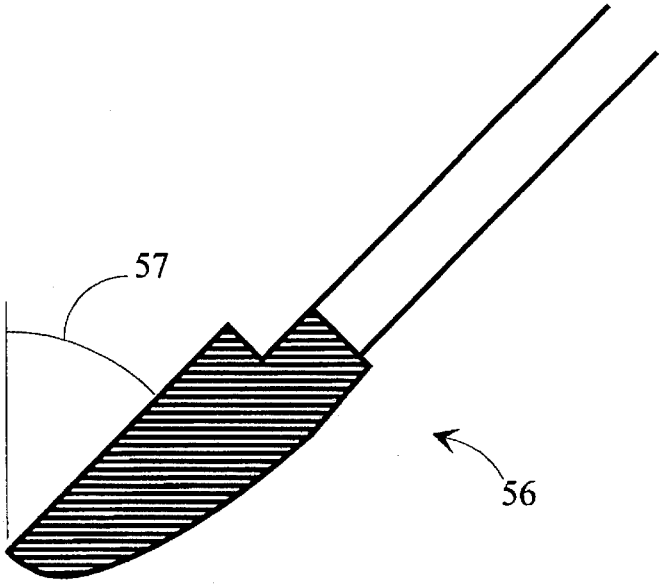
Fig. 15 (PRIOR ART)
FIGS. 15 and 16 are cross sectional side views of a standard iron and its equivalent according to one aspect of the present invention, respectively.
Figure 16:
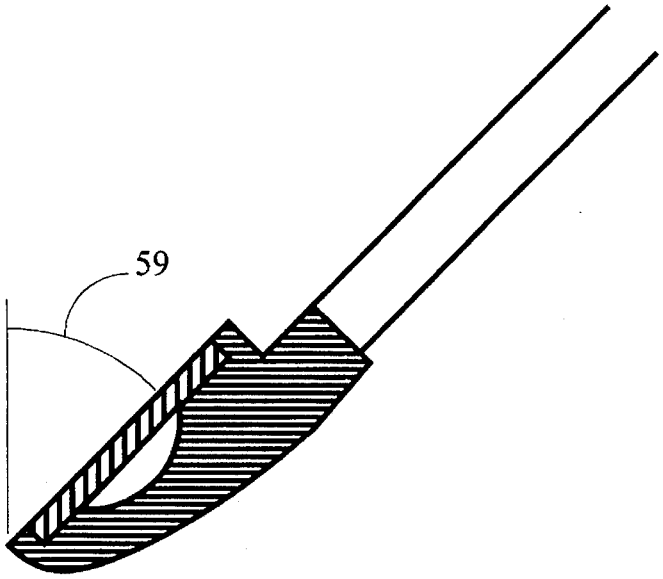
Figure 17:
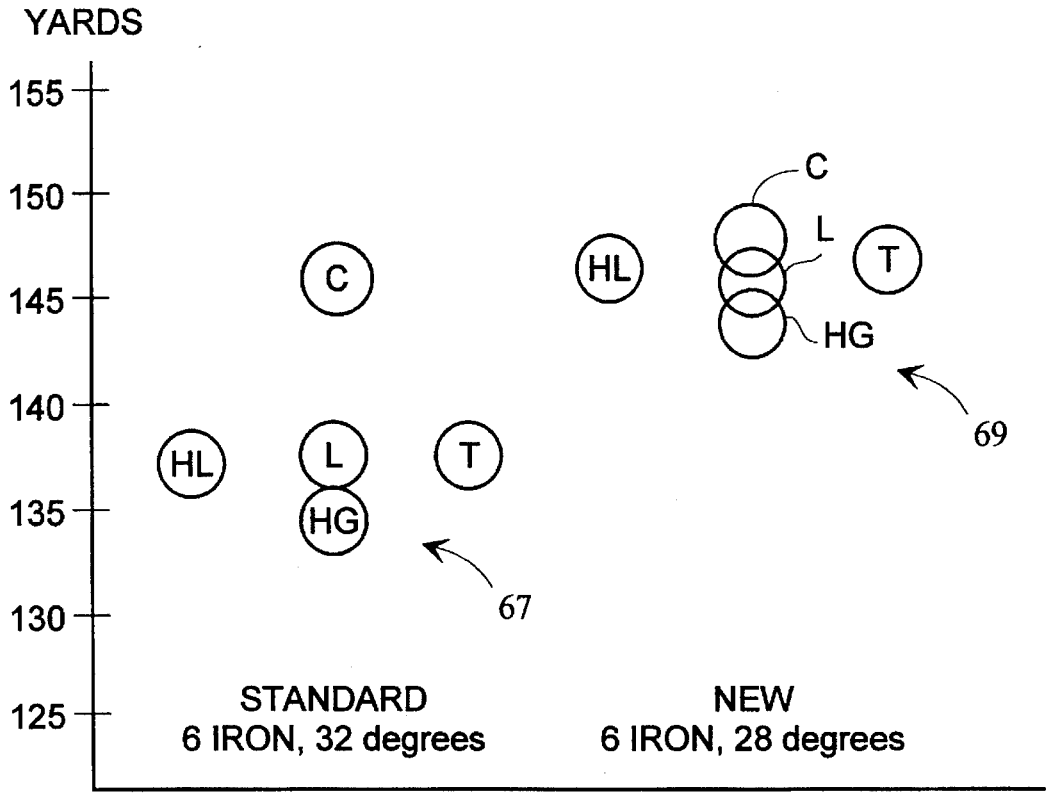
FIG. 17 is a face mapping chart illustrating the distance reaction spectrum of the club heads of FIGS. 15 and 16.

As seen in FIG. 15, a standard specific distance club 56, e.g. a six iron, has a standard face angle, or loft 57, of thirty two degrees, and will have a distance reaction on center of about one hundred forty seven yards for an average golfer. Because a specific distance golf club 58 according to the present invention, as illustrated in FIG. 16, does not have a sweet spot, or increased on-center distance reaction, a reduced loft 59 is provided for the same numbered club, in this instance a six iron, in order to yield a distance reaction across a substantial area of the striking face of the same one hundred forty seven yards. Thus the golfer will more readily acclimate to a set of irons according to the present invention. Face mapping for the club heads of FIGS. 15 and 16 are shown in FIG. 17, as ref. nos. 67 and 69, respectively, to illustrate this principle.

While the present invention has been illustrated and described in connection with the preferred embodiments, it is not to be limited to the particular structure shown, because many variations thereof will be evident to one skilled in the art and are intended to be encompassed in the present invention as set forth in the following claims.

I claim:

1. A golf iron club head comprising:

A) the club head having a striking face with:

1) a center area, and 2) other striking face areas, including:

i) a toe area;

ii) a heel area, iii) a high area; and iv) a low area;

B) the center area having a first energy absorbing component which has means for absorbing more energy than the other striking face areas to thereby yield a distance reaction with a struck ball that is substantially the same as a distance reaction from the other striking face areas, thereby limiting the distance reaction spectrum over the striking face.

2. The golf iron club head according to claim one wherein: the first energy absorbing component comprises the club head having a void behind the center area, and a plug composed of a first material having greater compressibility than the other striking face areas, the plug filing the void and forming a portion of the striking face.

3. The golf iron club head according to claim two wherein: the void is a throughhole in the club head.

4. The golf iron club head according to claim two wherein: the void is not completely through the club head.

5. The golf iron club head according to claim two wherein: the void is behind at least some of the other striking face areas.

6. The golf iron club head according to claim five wherein: the void is behind at least a portion of each of the toe area and heel area.

7. The golf iron club head according to claim two wherein: the void is of greatest depth behind the center point of the club head.

8. The golf iron club head according to claim five wherein: the void is of greater depth behind the center area than behind the other striking face areas.

9. The golf iron club head according to claim one wherein:

the first energy absorbing component comprises the club head having a void therein behind the center area of the striking face, and a plate of stiff, but deformable material covering the void and serving as the striking face over the void, the plate being constructed and arranged so as to retain enough energy in the club head upon striking a golf ball to lessen the distance reaction spectrum of the club head.

10. The golf iron club head according to claim nine wherein: the void is a throughhole in the club head.

11. The golf iron club head according to claim nine wherein: the void is at least partially filled with a material having lesser stiffness than the material of the club head.

12. The golf iron club head according to claim nine wherein: the void is behind at least some of the other striking face areas.

13. The golf club head according to claim twelve wherein: the void is at least partially filled with a material having lesser stiffness than the material of the club head.

14. The golf iron club head according to claim twelve wherein: the void is of greater depth behind the center area than behind the other striking face areas.

15. The golf iron club head according to claim nine wherein: the void is of greatest depth behind the center point of the club head.

16. A golf iron club comprising:

A) a shaft;

B) a club head connected to the shaft, the club head having a striking face with:

1) a center area, and 2) other striking face areas, including:

i) a toe area, ii) a heel area, iii) a high area, and iv) a low area,

C) the center area of the striking face having a first energy absorbing component which has means for absorbing more energy than the other striking face areas to thereby yield a distance reaction with a struck ball that is substantially the same as a distance reaction from the other striking face areas, thereby limiting the distance reaction spectrum over the striking face.

17. The golf club iron according to claim sixteen wherein:

the first energy absorbing component comprises the club head having a void behind the center area, and a plug composed of material having lesser stiffness than the other striking face areas, the plug filling the void and forming a portion of the striking face.

18. The golf club iron according to claim sixteen wherein:

the first energy absorbing component comprises the club head having a void therein behind the center area of the striking face, and a plate of stiff, but deformable material covering the void and serving as the striking face over the void, the plate being constructed and arranged so as to retain enough energy in the club head upon striking a golf ball to lessen the distance reaction spectrum of the club head.

19. The golf club iron according to claim eighteen wherein: the void is at least patially filled with a material having lesser stiffness than the material of the club head.

20. A set of irons for a set of golf clubs, comprising:

A) a three iron with a loft of less than 20°,

B) a four iron with a loft of less than 24°,

C) a five iron with a loft of less than 28°,

D) a six iron with a loft of less than 32°,

E) a seven iron with a loft of less than 36°,

F) an eight iron with a loft of less than 40°,

G) a nine iron with a loft of less than 44°,

H) a pitching wedge with a loft of less than 48°,

I) each of the irons and wedges having: a shaft, and a club head connected to the shaft, the club head having a striking face with:

1) a center area, and 2) other striking face areas, including:

i) a toe area, ii) a heel area, iii) a high area, and iv) a low area;

the center area of the striking face having a first energy absorbing component which has means for absorbing more energy than the other club face areas to yield a distance reaction with a stuck ball that is substantially the same as a distance reaction from the other striking face areas, thereby limiting the distance reaction spectrum over the striking face.

21. The set of golf club irons according to claim twenty wherein:

the first energy absorbing component of each club head has a void behind the center area, and a plug composed of a first material having lesser stiffness than the other striking face areas, the plug filling the void and forming a portion of the striking face.

22. The set of golf club irons according to claim twenty wherein:

the first energy absorbing component of each club head has a void therein behind the center area of the striking face, and a plate of stiff, but deformable material covering the void and serving as the striking face over the void, the plate being constructed and arranged so as to retain enough energy in the club head upon striking a golf ball to lessen the distance reaction spectrum of the club head.

* * * * *